US009310826B2

(12) United States Patent
Wurn et al.

(10) Patent No.: US 9,310,826 B2
(45) Date of Patent: Apr. 12, 2016

(54) VEHICLE PEDAL ASSEMBLY INCLUDING PEDAL ARM STUB WITH INSERTS FOR ACTUATOR BAR

(71) Applicants: Michael L Wurn, Osceola, IN (US); Steven P Howard, Osceola, IN (US); Christopher M Byrd, Elkhart, IN (US)

(72) Inventors: Michael L Wurn, Osceola, IN (US); Steven P Howard, Osceola, IN (US); Christopher M Byrd, Elkhart, IN (US)

(73) Assignee: CTS Corporation, Elkhart, IN (US)

( * ) Notice: Subject to any disclaimer, the term of this patent is extended or adjusted under 35 U.S.C. 154(b) by 0 days.

(21) Appl. No.: 14/300,906

(22) Filed: Jun. 10, 2014

(65) Prior Publication Data

US 2014/0366678 A1 Dec. 18, 2014

Related U.S. Application Data

(60) Provisional application No. 61/834,315, filed on Jun. 12, 2013.

(51) Int. Cl.

| | |
|---|---|
| ***G05G 1/30*** | (2008.04) |
| ***G05G 1/445*** | (2008.04) |
| ***G05G 1/44*** | (2008.04) |
| ***G05G 5/03*** | (2008.04) |

(52) U.S. Cl.

CPC ..... *G05G 1/445* (2013.01); *G05G 1/44* (2013.01); *G05G 5/03* (2013.01); *Y10T 74/20534* (2015.01)

(58) Field of Classification Search

CPC ..... G05G 1/30; G05G 1/46; G05G 5/03; B60K 26/02; B60K 2026/023; B60K 26/021; B60T 7/06

USPC ..... 74/512, 513

See application file for complete search history.

(56) References Cited

U.S. PATENT DOCUMENTS

| | | | | |
|---|---|---|---|---|
| 4,958,607 | A * | 9/1990 | Lundberg | 123/399 |
| 5,010,782 | A | 4/1991 | Asano et al. | |
| 5,063,811 | A * | 11/1991 | Smith et al. | 74/513 |

(Continued)

FOREIGN PATENT DOCUMENTS

| | | | | |
|---|---|---|---|---|
| DE | 1233322 | A2 * | 8/2002 | B60K 26/02 |
| DE | 202005004272 | U1 | 7/2005 | |

(Continued)

OTHER PUBLICATIONS

CTS Corporation, CTS Automotive Products, Pedal Module Products and Specifications, www.ctscorp.com/automotive/pedal/specifications.htm 2014, CTS Corporation, Elkhart Indiana 46514.

(Continued)

*Primary Examiner* — Vicky Johnson
(74) *Attorney, Agent, or Firm* — Daniel Deneufbourg

(57) ABSTRACT

A vehicle pedal assembly comprising a pedal including a pedal stub arm having a metal pedal arm molded into a plastic stem with inserts molded therein and an actuator bar coupled to the stem of the pedal. Fasteners extend through the actuator bar and into the inserts in the stem for securing the actuator bar to the pedal. The actuator bar is adapted to exert an active force against the pedal. In one embodiment, both the pedal arm and the actuator bar include one or more bends defined therein. The pedal arm has a length and shape dependent upon the distance and position of the floor or pedal pad relative to the pedal. The actuator bar has a length and shape dependent upon the distance and position of the pedal relative to an actuator arm.

9 Claims, 4 Drawing Sheets

(56) References Cited

U.S. PATENT DOCUMENTS

| | | | | |
|---|---|---|---|---|
| 5,078,024 | A | 1/1992 | Cicotte et al. | |
| 5,771,752 | A | 6/1998 | Cicotte | |
| 5,927,154 | A | 7/1999 | Elton et al. | |
| 6,301,993 | B1 | 10/2001 | Orr et al. | |
| 6,321,617 | B1 | 11/2001 | Schwyn | |
| 6,324,939 | B1 | 12/2001 | Cicotte | |
| 6,367,349 | B1 | 4/2002 | Allen et al. | |
| 6,431,022 | B1 | 8/2002 | Cicotte | |
| 6,564,672 | B2 | 5/2003 | Brock et al. | |
| 6,722,226 | B2 | 4/2004 | Neag et al. | |
| 6,782,776 | B2 | 8/2004 | Oberheide et al. | |
| 6,792,827 | B2 | 9/2004 | Willemsen | |
| 6,840,132 | B2 | 1/2005 | Gohrbandt et al. | |
| 6,918,316 | B2 | 7/2005 | Johansson et al. | |
| 7,404,342 | B2 | 7/2008 | Wurn | |
| 7,530,289 | B2 | 5/2009 | Willemsen et al. | |
| 7,568,406 | B2 | 8/2009 | Booher et al. | |
| 7,673,538 | B2 | 3/2010 | Choi | |
| 2001/0007206 | A1* | 7/2001 | Kato | B60K 26/02 73/114.01 |
| 2004/0020323 | A1 | 2/2004 | Harth et al. | |
| 2004/0129106 | A1 | 7/2004 | Prat et al. | |
| 2008/0229872 | A1 | 9/2008 | Bray | |
| 2011/0296946 | A1* | 12/2011 | Hotta | G05G 1/445 74/563 |
| 2013/0133466 | A1* | 5/2013 | Inuzuka et al. | 74/513 |
| 2013/0133471 | A1 | 5/2013 | Tchernyi et al. | |
| 2013/0152725 | A1* | 6/2013 | Maruyama | B60K 26/021 74/513 |
| 2013/0186228 | A1* | 7/2013 | Saito et al. | 74/513 |

FOREIGN PATENT DOCUMENTS

| | | | |
|---|---|---|---|
| DE | 102008057661 | A1 | 6/2009 |
| DE | 102012105148 | A1 | 5/2013 |
| EP | 13655303 | A2 | 11/2003 |
| EP | 2172358 | A2 | 7/2010 |
| WO | 2011136038 | A1 | 3/2011 |

OTHER PUBLICATIONS

Wilwood, Wilwood Pedals and Accessories, www.wilwood.com/Pedals/PedalList.aspx 2014, Wilwood.

* cited by examiner

VEHICLE PEDAL ASSEMBLY INCLUDING PEDAL ARM STUB WITH INSERTS FOR ACTUATOR BAR

CROSS-REFERENCE TO RELATED AND CO-PENDING APPLICATION

This application claims the benefit of the filing date and disclosure of U.S. Provisional Patent Application Ser. No. 61/834,315 filed on Jun. 12, 2013 which is incorporated herein by reference as are all references cited therein.

FIELD OF THE INVENTION

The present invention relates generally to a vehicle pedal assembly and, more specifically, to the pedal stub arm and the actuator bar of an active force vehicle accelerator pedal assembly.

BACKGROUND OF THE INVENTION

Vehicle accelerator pedal assemblies are available which incorporate structure that allows for the application of an active force against the pedal, in the form of for example a vibration force, that is intended to provide the operator of the vehicle with a sensory indication of the detection by one of the sensors of the vehicle of a vehicular condition such as for example the excessive speed of the vehicle.

The present invention is directed to an active force vehicle accelerator pedal assembly incorporating a new structure for allowing the application of the active force against the pedal.

SUMMARY OF THE INVENTION

The present invention is directed to a vehicle pedal assembly comprising a pedal housing, a pedal including a pedal arm extending outwardly from the pedal housing and a pedal stub extending into the pedal housing, and an actuator bar including a proximal end coupled to the pedal stub and adapted for application of an active force on the pedal.

In one embodiment, the pedal stub includes a drum that extends into the pedal housing and is adapted for rotation relative to the pedal housing and a stem unitary with the drum that extends outwardly from the pedal housing, the proximal end of the actuator bar being coupled to the stem of the pedal stub.

In one embodiment, the stem includes a pair of threaded inserts molded therein, the proximal end of the actuator bar including a pair of through-holes, and further including a pair of fasteners extending through the pair of through-holes and the pair of inserts respectively for coupling the actuator bar to the pedal.

In one embodiment, the actuator bar is made of metal and has a length and bends defined therein and dependent upon the predetermined required distance and position between the pedal and an actuator arm.

In one embodiment, the pedal arm is made of metal and is over molded into the plastic material of the stem of the pedal stub.

In one embodiment, the pedal arm has a length and bends defined therein and dependent upon the predetermined required distance between the pedal and the vehicle.

The present invention is also directed to an active force vehicle accelerator pedal assembly comprising a pedal housing, a pedal extending into the pedal housing, the pedal including a pedal arm molded into a stem, the stem including at least a first insert molded therein, an actuator bar defining at least a first through hole, the actuator bar being abutted against the stem with the at least first through hole in alignment with the at least first insert in the stem of the pedal, and at least a first fastener extending through the at least first through hole in the actuator bar and the at least first insert in the stem for coupling the actuator bar to the pedal, the actuator bar being adapted for application of an active force against the pedal.

In one embodiment, a pair of inserts are molded into the stem of the pedal, a pair of through holes are defined in the actuator bar, and a pair of fasteners extend through the pair of through holes and the pair of inserts respectively.

In one embodiment, the actuator bar includes a plurality of bends defined therein, the number and orientation being determined by the required distance and position between the pedal and an actuator arm.

In one embodiment, the pedal arm includes a plurality of bends defined therein, the number and orientation being determined by the required distance and position of the pedal relative to the vehicle.

The present invention is further directed to an active force vehicle accelerator pedal assembly comprising a pedal housing defining an interior, a pedal including a pedal arm molded into a pedal stub, the pedal arm including one or more bends defined therein, the pedal stub including a stem and a drum unitary with the stem, the drum extending into the interior of the pedal housing and the stem extending outwardly from the pedal housing, the stem including a plurality of inserts molded therein, an actuator bar including a proximal end defining a plurality of through holes and one or more bends defined therein, the proximal end of the actuator bar abutting against the stem of the pedal stub with the plurality of through holes in alignment with the plurality of inserts in the stem of the pedal, and a plurality of fasteners extending respectively through the through holes in the actuator bar and into the plurality of inserts in the stem of the pedal stub for coupling the actuator bar to the pedal, the actuator bar being adapted to exert an active force against the pedal.

In one embodiment, the pedal arm and the actuator bar are made of metal and the pedal housing and the pedal base are made of molded plastic material.

In one embodiment, the number and orientation of the bends in the pedal arm and the actuator bar is determined by the required distance and location of the pedal relative to the vehicle and the distance and location of the pedal relative to an actuator arm respectively.

Other advantages and features of the present invention will be more readily apparent from the following detailed description of the embodiments of the invention, the accompanying drawings, and the appended claims.

BRIEF DESCRIPTION OF THE DRAWINGS

In the accompanying drawings that form part of the specification, and in which like numerals are employed to designate like parts throughout the same.

DETAILED DESCRIPTION OF THE EMBODIMENTS

Figure 1:
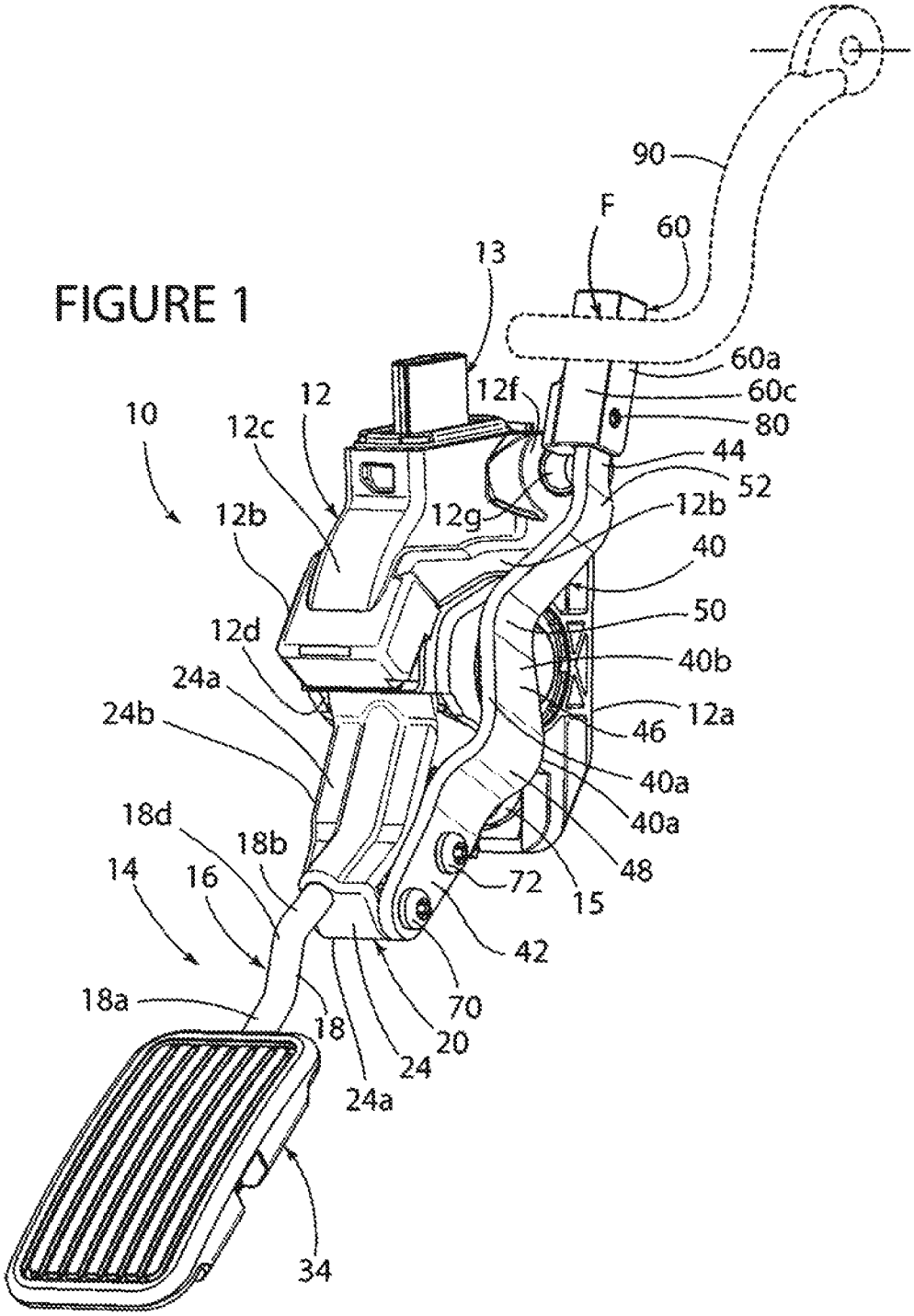
FIG. 1 is a perspective view of an active force vehicle accelerator pedal assembly according to the present invention.
Figure 2:
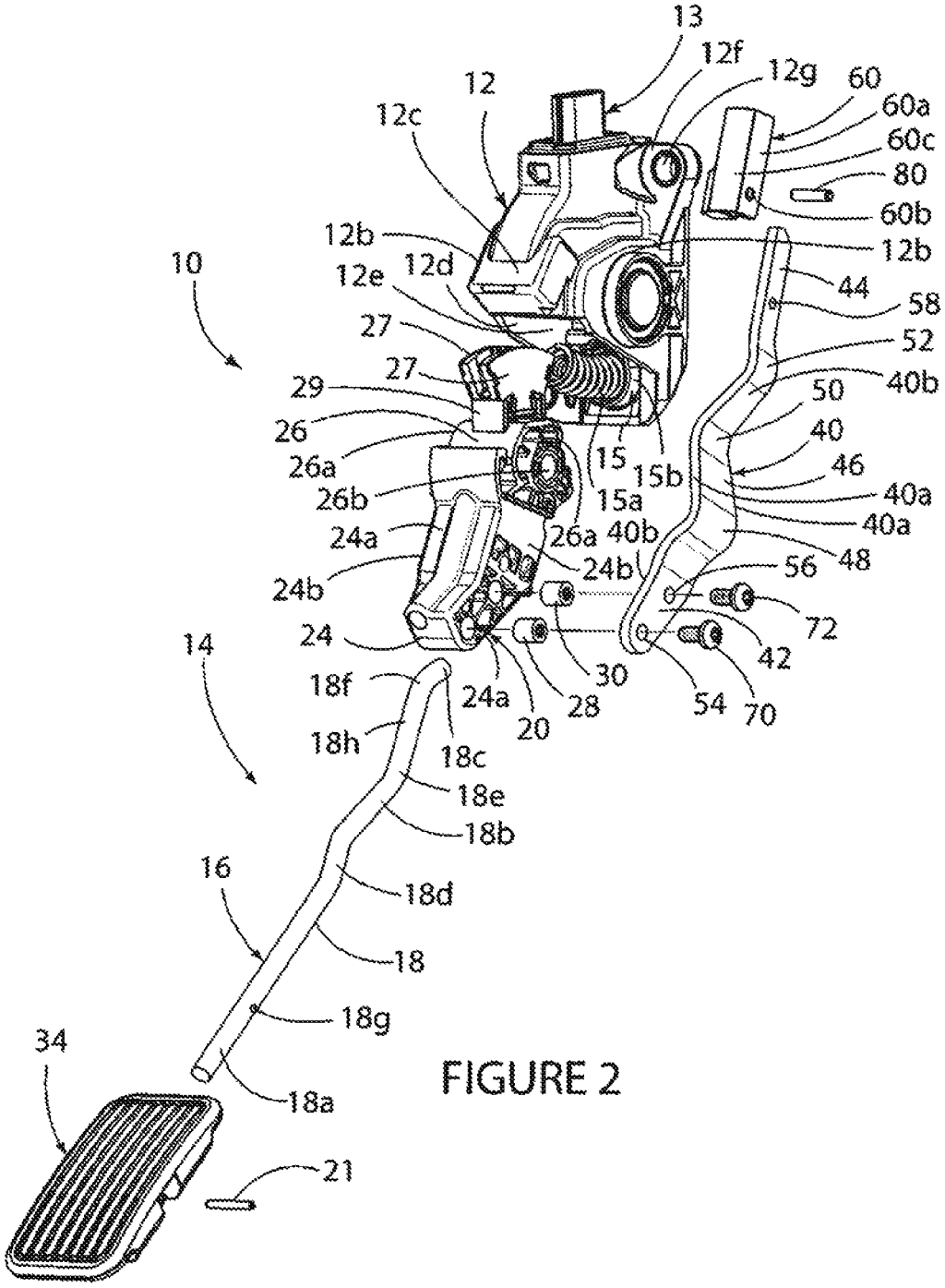
FIG. 2 is an exploded perspective view of the active force vehicle accelerator pedal assembly shown in FIG. 1.

FIGS. 1 and 2 depict one embodiment of an active force vehicle pedal assembly 10 according to the present invention which, in the embodiment shown, is in the form of a vehicle accelerator pedal assembly.

The active force vehicle accelerator pedal assembly 10 comprises a pedal housing 12 which, in the embodiment shown, is made of a molded plastic material and includes a back housing base or wall 12*a*, a pair of spaced-apart housing side walls 12*b* extending generally normally outwardly from opposed spaced-apart edges of the back housing base or wall 12*a*, and a front or top housing wall 12*c* extending between the front or top edges of the pair of housing side walls 12*b*. The base wall 12*a*, side walls 12*b*, and the top wall 12*c* together define a pedal housing 12 with a front housing opening 12*d* and an interior housing cavity 12*e*.

A sensor connector assembly 13 extends through a top or back opening not shown) defined in the top wall 12*c* of the pedal housing 12 and into the interior housing cavity 12*e*. The sensor connector assembly 13 includes a non-contacting Hall-effect integrated circuit sensor (not shown) that extends into the interior housing cavity 12 and is of the type shown in for example U.S. Pat. No. 7,404,342, the disclosure and contents of which are incorporated herein by reference.

The interior housing cavity 12*e* is also adapted to house a pedal friction and hysteresis assembly 15 of the type disclosed in for example U.S. Pat. No. 7,404,342, the disclosure and contents of which are also incorporated herein by reference. FIG. 2 depicts only the spring 15*a* and the friction plate 15*b* of the pedal friction and hysteresis assembly 15.

The pedal housing 12 also includes a plurality of brackets 12*f* (only one of which is shown in FIGS. 1 and 2) extending from the exterior surface of one or more of the walls of the pedal housing 12 and defining respective apertures 12*g* adapted to receive respective fasteners (not shown) adapted to allow the securement of the pedal housing 12 and thus the active force pedal assembly 10 to either the floor (not shown) of a vehicle (not shown) or to a mounting bracket (not shown) adapted for coupling to the floor of a vehicle.

The active force vehicle pedal assembly 10 also comprises an elongated pedal 14 which, in the embodiment shown, is comprised of a pedal stub arm 16 that includes an elongate generally rounded or cylindrically shaped steel pedal arm 18 including a first distal end over molded into a pedal base or stub 20, and a pedal foot pad 34 secured to a second proximal end of the pedal arm 18.

In the embodiment shown, the elongate pedal arm 18 includes a plurality of respective unitary straight and bent sections or regions including for example, in the embodiment shown, respective straight sections or regions 18*a*, 18*b*, 18*h*, 18*c* and respective upwardly and downwardly curved or bent sections or regions 18*d*, 18*e*, and 18*f*. In the embodiment shown, the straight sections 18*a* and 18*c* define the respective proximal and distal end sections of the elongate pedal arm 18. Further, in the embodiment shown, the bent section 18*d* is located between the two straight sections 18*a* and 18*b*, the bent section 18*e* is located between the straight sections 18*b* and 18*h*, and the bent section 18*f* is located between the straight sections 18*h* and 18*c*. In the embodiment shown, a through aperture 18*g* is defined in and extends through the body of the straight proximal end section 18*a* of the pedal arm 18.

The pedal foot pad 34 is, in the embodiment shown, made of a suitable molded plastic material and is adapted to be slid onto the proximal end of the pedal arm 18 and, more specifically, onto the proximal straight section 18*a* of the pedal arm 18 and secured thereto via an elongate pin 21 that extends through the pad 34 and through the aperture 18*g* defined in the pedal arm 18.

The pedal base or stub 20 is, in the embodiment shown, also made of a suitable molded plastic material and is comprised of a generally rectangular shaped and elongate stem 24 and a generally rounded drum 26. The stem 24 protrudes and extends unitarily outwardly from a proximal end or side of the drum 26 and a pair of sensor magnets 27 are coupled to a magnet bracket 29 that is unitary with and extends outwardly from a distal end or side of the drum 26 opposite the proximal end or side that includes the stem 24.

In the embodiment shown, the stem 24 includes opposed top and bottom exterior surfaces 24*a* and opposed side exterior surfaces 24*b*. A pair of generally cylindrically shaped open and interiorly threaded metal fastener receiving inserts 28 and 30 are formed, molded into, and defined in the coring of the stem 24. In the embodiment shown, the metal inserts 28 and 30 define respective openings in one of the side exterior surfaces 24*b* of the stem 24 and extend into the body and plastic material of the stem 24. Moreover, in the embodiment shown, the inserts 28 and 30 are positioned and extend into the stem 24 in a spaced-apart, parallel, and co-linear relationship relative to each other and in a direction and relationship generally normal to the respective longitudinal axis of the stem 24, the elongate pedal arm 18, and the pedal assembly 10.

In the embodiment shown, the drum 26 includes a pair of opposed and spaced-apart exterior sides 26*a* and defines a central shaft receiving through aperture 26*b* extending through the drum 26 in a relationship and direction generally normal to the respective longitudinal axis of the stem 24, the elongate pedal arm 18, and the pedal assembly 10. The through aperture 26*b* defines respective openings in the respective sides 26*a* of the drum 26.

The pedal 14 is secured to the pedal housing 12 of the pedal assembly 10 in a relationship wherein the drum 26 of the pedal base or stub 20 extends through the opening 12*d* of the pedal housing 12 and into the interior cavity 12*e* of the pedal housing 12. A shaft (not shown), but of the type disclosed in for example U.S. Pat. No. 7,404,342, the disclosure and contents of which are incorporated herein by reference, is adapted to extend through the through aperture 26*b* in the drum 26 for mounting the drum 26 to the pedal housing 12 and more specifically for mounting the drum 26 of the pedal 14 in the pedal housing 12 for rotation relative to the pedal housing 12 and thus, in the orientation of the pedal assembly 10 as shown in the FIGURES, for mounting the pedal 14 to the pedal housing 12 for counterclockwise rotation relative to the pedal housing 12 when the pedal 14 is depressed by the foot of the vehicle operator from its idle position to cause the acceleration of the vehicle; and for clockwise rotation of the pedal 14 relative to the pedal housing 12 when the vehicle operator removes his/her foot from the pedal 14 to decelerate the vehicle and return the pedal 14 to its idle position.

As shown in FIG. 1, the active force vehicle pedal assembly 10 further comprises an elongate metal actuator bar or lever 40 including a proximal end 42 adapted for coupling to the stem 24 of the base or stub 20 of the pedal 14, a distal end 44 adapted for contact with the arm 90 of an actuator (not shown), and an elongate intermediate mid-portion 46 between and unitary with the respective ends 42 and 44 which, in the embodiment shown, has been bent to define a plurality of spaced apart inwardly and outwardly extending bends or elbows 48, 50, and 52. The proximal end 42 of the elongate actuator bar 40 defines a pair of through holes 54 and 56 and the distal end 44 defines a through hole 58.

In the embodiment shown, the actuator bar 40 includes opposed top and bottom exterior flat surfaces 40*a* and opposed side exterior surfaces 40*b*. The through holes 54, 56, and 58 extend through and between the opposed side exterior surfaces 40*b* and define respective openings in the opposed side exterior surfaces 40*b*.

The proximal end 42 of the actuator bar 40 is coupled to the stem 24 of the base or stub 20 of the pedal 14 in a relationship wherein: the exterior side surface 40*b* of the proximal end 42 of the actuator bar 40 is abutted against the exterior side surface 24*b* of the stem 24 of the base or stub 20 of the pedal 14; the pair of through holes 54 and 56 defined in the proximal end 42 of the actuator bar 40 are positioned in a relationship aligned with the respective inserts 28 and 30 molded into the stem 24 of the base or stub 20 of the pedal 14; and a pair of suitable fasteners such as screws or bolts 70 and 72 are extended and threaded through the respective aligned through holes 54 and 56 in the actuator bar 40 and into the respective threaded inserts 28 and 30 defined in the stem 24 of the base or stub 20 of the pedal 14 to secure the actuator bar 40 to the pedal 14.

The distal end 44 of the actuator bar 40 includes a molded plastic actuator arm contact bracket or clip or cap 60 which, in the embodiment shown, includes a pair of opposed and spaced apart side walls 60*a* each defining a through aperture or hole 60*b*, and a top or front wall 60*c*. The distal end 44 of the actuator bar 40 is slid into and between the side walls 60*a* of the bracket 60 into a relationship wherein the through aperture 58 defined in the distal end 44 of the actuator bar 40 is aligned with the through aperture or hole 60*b* defined in the respective side walls 60*a* of the bracket 60. A pin 80 is then inserted into and through the respective aligned through apertures 60*b* and 58 in the bracket 60 and the actuator bar 40 respectively for coupling the bracket 60 to the actuator bar 40.

Thus, in the embodiment of FIG. 1, the actuator bar 40 is positioned, oriented, and extends generally upwardly from the stem 24 of the pedal base or stub 20 in a relationship generally co-linear with the longitudinal axis of the stem 24 of the pedal base or stub 20 and further in a relationship opposed, spaced, and generally parallel to the pedal housing 12 and still more specifically in a relationship opposed, paced, and generally parallel to the side wall 12*b* of the pedal housing 12.

Thus, still further, it is understood that activation of the actuator (not shown) that is coupled to the distal end of the actuator arm 90, in response to the sensing of a vehicle condition such as for example excessive speed of the vehicle or inadequate safe distance between vehicles, is intended to cause the proximal end of the actuator arm 90 shown in FIG. 1 to contact the bracket 60 and exert or apply an active force, generally designated and represented by the arrow F in FIG. 1 and which for example may be in the form of a constant force or vibration, against the top wall 60*c* of the bracket 60 which in turn is transferred to the distal end 44 of the actuator bar 40 which in turn is transferred through the actuator bar 40 and into the proximal end 42 of the actuator bar 40 which in turn is transferred to the pedal 14 through the stub 20 which in turn is transferred to the foot of the operator of the vehicle as an active haptic pedal push back or feedback force, which in turn is intended to provide the operator with a sensory indication of the vehicle condition requiring the vehicle operator to for example remove his/her foot from the pedal 14. In the embodiment show, the distal contact segment of the actuator arm 90 is disposed in a relationship generally normal to the bracket 60 so as to allow for the application of an evenly distributed line force against the bracket 60.

In accordance with the present invention, the combination of the use of a pedal assembly 10 that includes a pedal stub arm 16 with rounded pedal arm 18; a pedal base or stub 20 including a stem 24 with threaded inserts 28 and 30; and an actuator bar 40 with bends and elbows 48, 50, and 52 allow for more room to clear the floor (not shown) of the vehicle (not shown) and provide the required pedal arm strength.

In particular, the use of the pedal stub arm 16 including a pedal arm 18 that is over molded into the stem 24 of a pedal base or stub 20 allows for the length of the pedal 14 to be varied and adjusted and, more specifically, allows for the length of the pedal arm 18 of the pedal 14 and the number and orientation and shape of the bends defined therein to be varied and adjusted depending upon the application and, still more specifically, allows for the length or shape of the pedal arm 18 and the bends defined therein to be varied and adjusted depending upon the distance required in a particular application between the floor of the vehicle and the pedal 14.

Stated another way, the present invention advantageously provides a pedal assembly 10 in which the same pedal housing 12, the same pedal base or stub 20, and the same pedal plate 36 can be used in all vehicle applications and which requires only the use of a different pedal arm 18 having a length, shape, and bends customized and fitted for the particular application and more specifically a length, shape, and bends which have been predetermined by for example the distance required in a particular application between the pedal pad 36 and the pedal housing 12, or the distance required between the floor of the vehicle and the pedal housing 12 in another example.

The use of a pedal stem 24 with threaded actuator bar inserts 28 and 30 also allows for the position of the threaded actuator bar inserts 28 and 30 in the stem 24 to be varied or adjusted on the stem 24 depending upon the application and, more particularly, to be varied or adjusted depending upon the distance required between the pedal 14 and the active force actuator.

Further, the use of the actuator bar 40 with the bends and elbows 48, 50, and 52 allows for the length, position, and orientation of the actuator bar 40 and the bends and elbows defined therein to be varied or adjusted depending upon the application and, more particularly, depending upon the required distance, positioning, and orientation between the pedal 14 and the active force actuator and, more specifically, the arm of the actuator.

Stated another way, the present invention advantageously provides a pedal assembly 10 in which the same pedal housing 12, the same pedal base or stub 20, and the same pedal plate 36 can be used in all vehicle applications and which requires only the adjustment of the location of the inserts 28 and 30 in the pedal base or stub 20 and/or the use of a different actuator arm 40 having a length, shape, and bends customized and fitted to the particular application and more particularly a length, shape, and bends which have been predetermined depending upon the required distance and spacing between the pedal assembly 10 and the actuator and more specifically the actuator arm.

Figure 3:
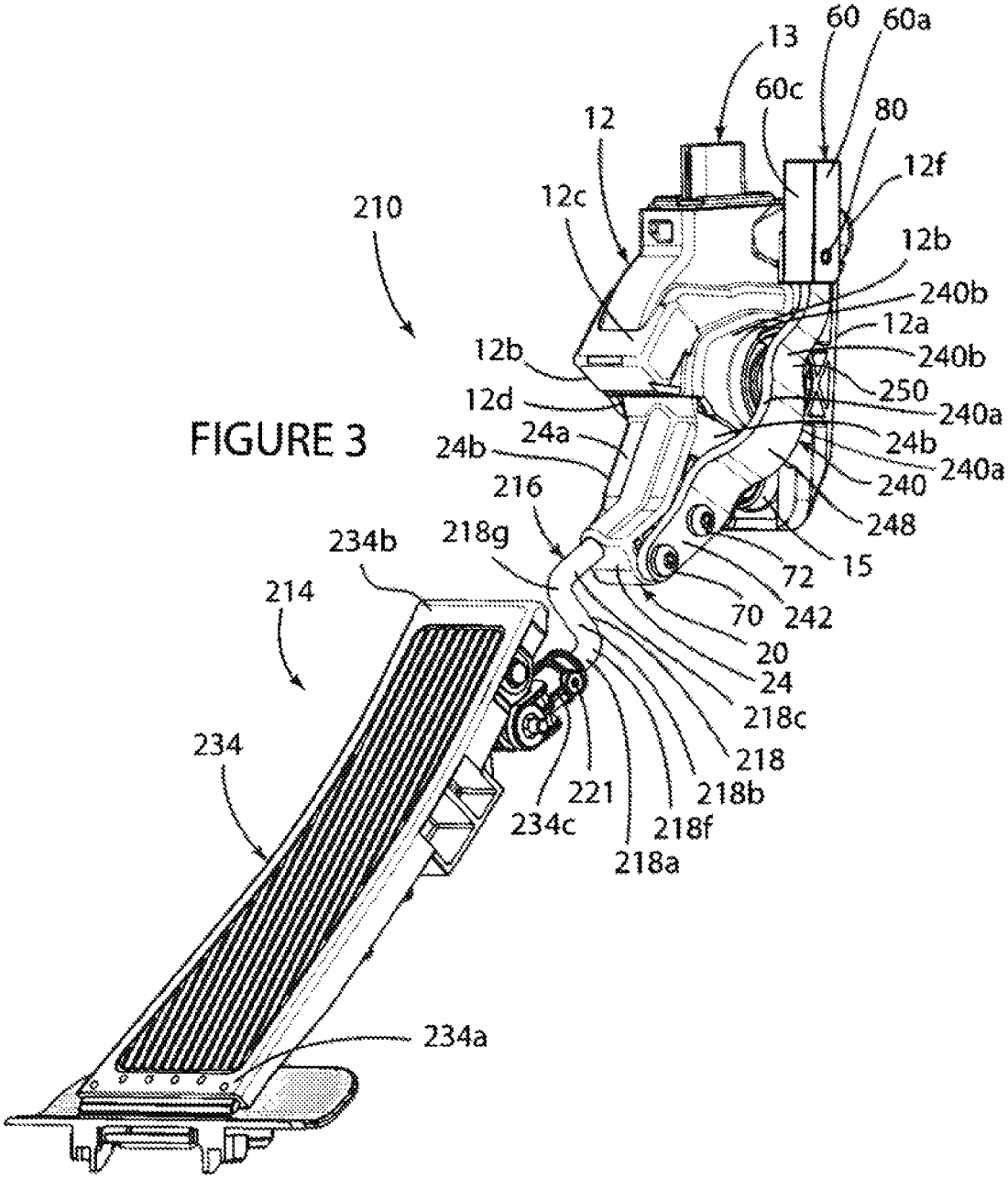
FIG. 3 is a perspective view of another embodiment of an active force vehicle accelerator pedal assembly according to the present invention.
Figure 4:
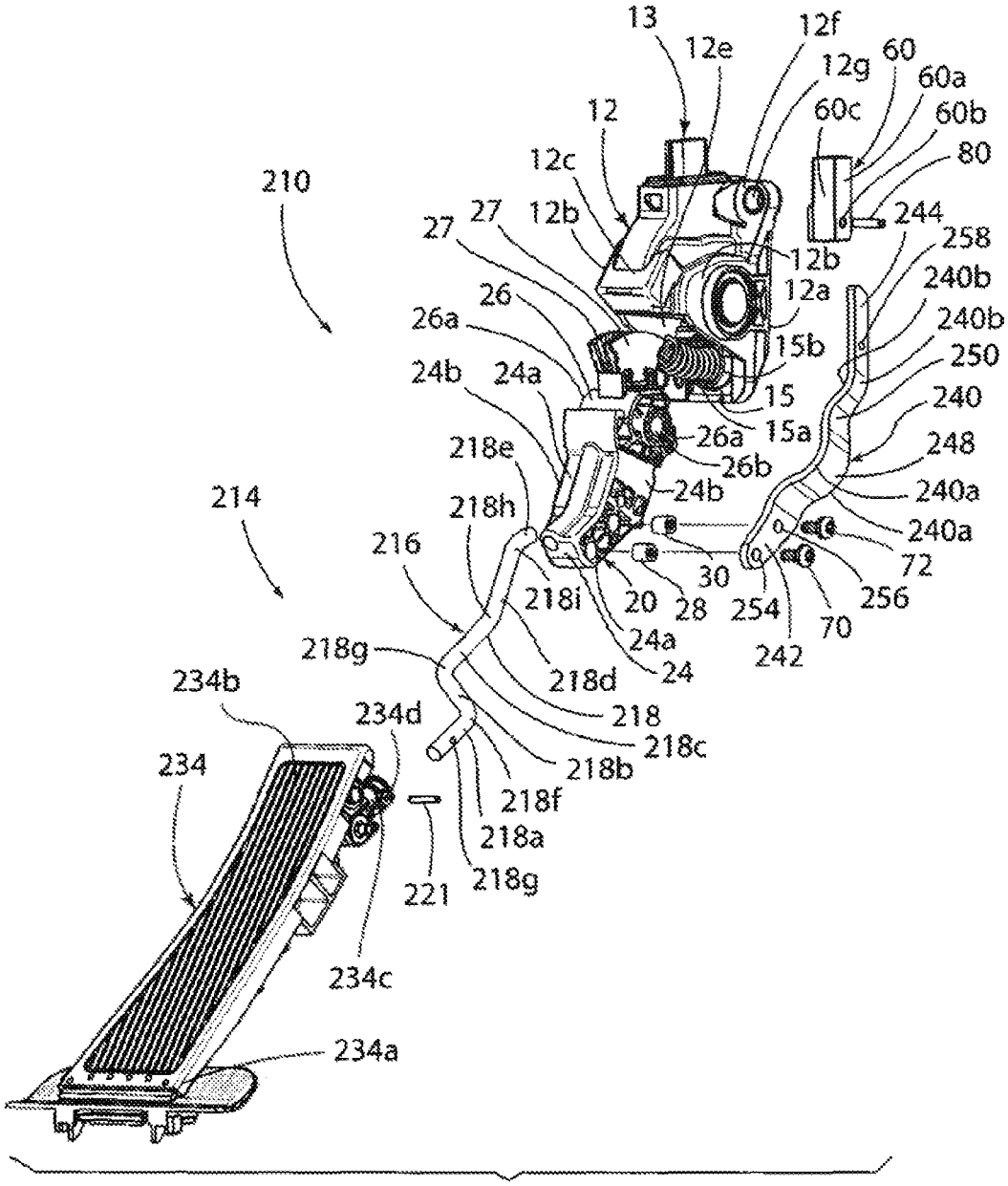
FIG. 4 is an exploded perspective view of the active force vehicle accelerator pedal assembly shown in FIG. 3.

FIGS. 3 and 4 depict a second embodiment of an active force vehicle pedal assembly 210 according to the present invention which, in the embodiment shown, is also in the form of a vehicle accelerator pedal assembly.

The active force vehicle pedal assembly 210 comprises a pedal housing 12 which, in the embodiment shown, is of a construction and function identical to the pedal housing 12 of the active force vehicle pedal assembly 10 shown in FIGS. 1 and 2 and thus the earlier description of the structure and function of the several elements of the pedal housing 12 of the active force vehicle pedal assembly 10 and the various elements of the sensor and friction assemblies adapted to be located in the interior cavity 12*e* thereof is incorporated herein by reference with respect to the pedal housing, sensor, and friction elements identified in FIGS. 3 and 4 for the pedal housing 12 of the active force vehicle pedal assembly 210.

The active force vehicle pedal assembly 210 also comprises an elongated pedal 14 which, in the embodiment shown, is comprised of a pedal stub arm 216 that includes an elongate generally rounded or cylindrically shaped steel pedal arm 218 including a first distal end over molded onto a pedal base or stub 20, and a pedal foot pad 234 secured to a second proximal end of the pedal arm 218.

In the embodiment shown, the elongate pedal arm 218 includes a plurality of respective unitary straight and bent sections or regions including for example, in the embodiment shown, respective first, second, and third straight sections or regions 218*a*, 218*b*, 218*c*, 218*d*, and 218*e* and respective curved or bent sections or regions 218*f*, 218*g*, 218*h*, and 218*i*. In the embodiment shown, the straight sections 218*a* and 218*e* define the respective proximal and distal end sections of the elongate pedal arm 218. Further, in the embodiment shown, the bent section 218*f* is located between the two straight sections 218*a* and 218*c*, the bent section 218*h* is located between the straight sections 218*c* and 218*d*, and the bent section 218*i* is located between the two straight sections 218*d* and 218*e*. In the embodiment shown, a through aperture 218*g* is defined in and extends through the body of the straight proximal end section 218*a* of the pedal arm 18.

The pedal foot pad 234 is, in the embodiment shown, made of a suitable molded plastic material and is of a floor mount type including a first proximal end 234*a* adapted for securement to, and rotation relative to, the floor (not shown) of a vehicle (not shown). The pedal foot pad 234 includes a second distal end 234*b* including an open stem or receptacle 234*c* on the underside thereof that is adapted to receive the straight end section 218*a* of the pedal arm 218. An elongate pin 221 extends through a through hole 234*d* defined in the stem 234*c* of the pedal foot pad 234 and into the through hole 218*g* defined in the straight end section 218*a* of the pedal arm 218 for coupling the pedal foot pad 234 to the pedal arm 218.

The pedal base or stub 20 is, in the embodiment of FIGS. 3 and 4, a construction and function identical to the pedal base or stub 20 of the active force vehicle pedal assembly 10 shown in FIGS. 1 and 2 and thus the earlier description of the structure and function of the several elements of the pedal base or stub 20 of the active force vehicle pedal assembly 10 is incorporated herein by reference with respect to the pedal base or stub 20 of the active force vehicle pedal assembly 210.

As shown in FIG. 3, the active force vehicle pedal assembly 210 further comprises an elongate metal actuator bar 240 including a proximal end 242 adapted for coupling to the stem 24 of the base or stub 20 of the pedal 214, a distal end 244 adapted for contact with the arm 90 of an actuator (not shown), and an elongate intermediate mid-portion 246 between and unitary with the respective ends 242 and 244 which, in the embodiment shown, has been bent to define a pair of bends or elbows 248 and 250. The proximal end 242 of the elongate actuator bar 240 defines a pair of through holes 254 and 256 and the distal end 244 defines a through hole 258.

In the embodiment shown, the actuator bar 240 includes opposed top and bottom exterior surfaces 240*a* and opposed side exterior surfaces 240*b*. The through holes 254, 256, and 258 extend through and between the opposed side exterior surfaces 240*b* and define respective openings in the opposed side exterior surfaces 240*b*.

The proximal end 242 of the actuator bar 240 is coupled to the stem 24 of the base or stub 20 of the pedal 214 in a relationship wherein: the exterior side surface 240*b* of the proximal end 242 of the actuator bar 240 is abutted against the exterior side surface 24*b* of the stem 24 of the base or stub 20 of the pedal 214; the pair of through holes 254 and 256 defined in the proximal end 242 of the actuator bar 240 are positioned in a relationship aligned with the respective inserts 28 and 30 molded into the stem 24 of the base or stub 20 of the pedal 214; and a pair of suitable fasteners such as screws or bolts 70 and 72 are extended and threaded through the respective aligned through holes 254 and 256 in the actuator bar 240 and into the respective threaded inserts 28 and 30 defined in the stem 24 of the base or stub 20 of the pedal 214 to secure the actuator bar 240 to the pedal 214.

The distal end 244 of the actuator bar 40 is coupled to the clip or cap 60 of an actuator which has a construction and function identical to the bracket 60 of the pedal assembly 10 and thus the earlier description of the structure and function thereof is incorporated herein by reference with respect to the bracket 60 of the pedal assembly 210.

In the embodiment of FIGS. 3 and 4, the distal end 244 of the actuator bar 240 is slid into and between the side walls 60*a* of the bracket 60 into a relationship wherein the through aperture 258 defined in the distal end 244 of the actuator bar 240 is aligned with the through aperture or hole 60*b* defined in the respective side walls 60*a* of the bracket 60. A pin 80 is then inserted into and through the respective aligned through apertures 60*b* and 258 in the bracket 60 and the actuator bar 240 respectively for coupling the bracket 60 to the actuator bar 240.

The operation, function, and advantages of the various elements of the pedal assembly 210 including the operation, function, and advantages of the pedal stub arm 216, the pedal arm 218, the pedal base or stub 20, and the pedal actuator bar 240 are the same as the operation, function, and advantages associated with the pedal stub arm 16, the pedal arm 18, the pedal base or stub 20, and the pedal actuator bar 40 of the pedal assembly 10 and thus the earlier description of the operation, function, and advantages of such elements with respect to the pedal assembly 10 is incorporated herein by reference with respect to the pedal assembly 210.

For example, in FIGS. 3 and 4, the length and shape of the pedal arm 218 and the bends defined therein was predetermined by the distance required between the floor mounted pedal pad 234 and the pedal assembly 210.

While the invention has been taught with specific reference to the embodiments shown, it is understood that a person of ordinary skill in the art will recognize that changes can be made in form and detail without departing from the spirit and the scope of the invention. The described embodiments are to be considered in all respects only as illustrative and not restrictive.

For example, and as described earlier, it is understood that, while the FIGURES disclose only respective pedal assemblies 10 and 210 with two differently shaped and sized respective pedal arms 18 and 218 and actuator bars 40 and 240, the present invention encompasses all such other shapes and sizes of such pedal arms and actuator bars which may be required depending upon the particular vehicle application.

For another example, and although the FIGURES depict one embodiment of the means for coupling the actuator bars 40 and 240 to the stem 24 of the pedal base or stub 20, it is understood that the invention encompasses other suitable coupling means.

What is claimed is:

1. A vehicle pedal assembly comprising:

a pedal housing;

a pedal including a pedal arm extending outwardly from the pedal housing and a pedal stub extending into the pedal housing; and an actuator bar including a proximal end coupled to the pedal stub and adapted for application of an active force on the pedal;

the pedal stub including a drum that extends into the pedal housing and is adapted for rotation to the pedal housing and a stem unitary with the drum that extends outwardly from the pedal housing, the proximal end of the actuator bar being coupled to the stem of the pedal stub; and the stem including a pair of threaded inserts molded therein, the proximal end of the actuator bar including a pair of through-holes, and further including a pair of fasteners extending through the pair of through-holes and the pair of inserts respectively for coupling the actuator bar to the pedal.

2. The vehicle pedal assembly of claim 1, wherein the actuator bar is made of metal and has a length and bends defined therein and dependent upon the predetermined required distance and position between the pedal and an actuator arm.

3. An active force vehicle accelerator pedal assembly comprising:

a pedal housing;

a pedal extending into the pedal housing, the pedal including a pedal arm molded into a stem, the stem including at least a first insert molded therein;

an actuator bar defining at least a first through hole, the actuator bar being abutted against the stem with the at least first through hole in alignment with the at least first insert in the stem of the pedal; and at least a first fastener extending through the at least first through hole in the actuator bar and the at least first insert in the stem for coupling the actuator bar to the pedal, the actuator bar being adapted for application of an active force against the pedal.

4. The active force vehicle accelerator pedal assembly of claim 3, wherein a pair of inserts are molded into the stem of the pedal, a pair of through holes are defined in the actuator bar, and a pair of fasteners extend through the pair of through holes and the pair of inserts respectively.

5. The active force vehicle accelerator pedal assembly of claim 3, wherein the actuator bar includes a plurality of bends defined therein, the number and orientation being determined by the required distance and position between the pedal and an actuator arm.

6. The active force vehicle accelerator pedal assembly of claim 3, wherein the pedal arm includes a plurality of bends defined therein, the number and orientation being determined by the required distance and position of the pedal relative to a floor of a vehicle.

7. An active force vehicle accelerator pedal assembly comprising:

a pedal housing defining an interior;

a pedal including a pedal arm molded into a pedal stub, the pedal arm including one or more bends defined therein, the pedal stub including a stem and a drum unitary with the stem, the drum extending into the interior of the pedal housing and the stem extending outwardly from the pedal housing, the stem including a plurality of inserts molded therein;

an actuator bar including a proximal end defining a plurality of through holes and one or more bends defined therein, the proximal end of the actuator bar abutting against the stem of the pedal stub with the plurality of through holes in alignment with the plurality of inserts in the stem of the pedal; and a plurality of fasteners extending respectively through the through holes in the actuator bar and into the plurality of inserts in the stem of the pedal stub for coupling the actuator bar to the pedal, the actuator bar being adapted to exert an active force against the pedal.

8. The active force vehicle accelerator pedal assembly of claim 7, wherein both the pedal arm and the actuator bar are made of metal and the pedal housing and the pedal base are made of molded plastic material.

9. The active force vehicle accelerator pedal assembly of claim 7, wherein the number and orientation of the bends in the pedal arm and the actuator bar is determined by the required distance and location of the pedal relative to a vehicle and the distance and location of the pedal relative to an actuator arm of the vehicle respectively.

* * * * *